US007100249B2

(12) United States Patent
Hurn

(10) Patent No.: US 7,100,249 B2
(45) Date of Patent: Sep. 5, 2006

(54) BUCKLE

(75) Inventor: Martyn Hurn, Kendal (GB)

(73) Assignee: Lowe Alpine Holdings Limited, (GB)

( * ) Notice: Subject to any disclaimer, the term of this patent is extended or adjusted under 35 U.S.C. 154(b) by 0 days.

(21) Appl. No.: 10/672,536

(22) Filed: Sep. 26, 2003

(65) Prior Publication Data

US 2005/0066484 A1 Mar. 31, 2005

(51) Int. Cl.
*A44B 11/04* (2006.01)

(52) U.S. Cl. ..... 24/199

(58) Field of Classification Search ..... 24/308, 24/318, 321, 169, 197–200; 2/421
See application file for complete search history.

(56) References Cited

U.S. PATENT DOCUMENTS

| | | | | | |
|---|---|---|---|---|---|
| 348,871 | A | * | 9/1886 | Wales | 24/199 |
| 518,833 | A | | 4/1894 | Cooper | 24/200 |
| 745,884 | A | * | 12/1903 | Morton | 24/198 |
| 779,279 | A | | 1/1905 | Hastings | 24/321 |
| 837,103 | A | * | 11/1906 | Nonnemacher | 24/198 |
| 1,221,741 | A | * | 4/1917 | Johnson | 24/169 |
| D77,435 | S | | 1/1929 | Rigold | D11/218 |
| 1,860,170 | A | * | 5/1932 | Bronson | 24/198 |
| 2,099,199 | A | * | 11/1937 | Devendor et al. | 24/198 |
| 2,212,862 | A | | 8/1940 | Hirsh | 24/198 |
| 2,267,235 | A | * | 12/1941 | Ginnel | 2/309 |
| 2,269,696 | A | | 1/1942 | Shaulson | 24/200 |
| 2,285,714 | A | | 6/1942 | Hirsh | 24/199 |
| D133,265 | S | | 8/1942 | Kasen | D11/218 |
| 2,293,562 | A | * | 8/1942 | Rosenthal | 24/200 |
| D157,386 | S | | 2/1950 | Lombardi | D11/218 |
| D184,191 | S | | 12/1958 | Noe | D11/220 |
| 3,121,270 | A | | 2/1964 | Den Broek Lourens et al. | 24/312 |
| D217,895 | S | | 6/1970 | Burleson | D11/218 |
| D356,658 | S | | 3/1995 | Bernart | D2/624 |
| D445,723 | S | | 7/2001 | Kim | D11/218 |
| D447,091 | S | | 8/2001 | Fildan et al. | D11/218 |
| D491,101 | S | | 6/2004 | Hsu | D11/210 |

FOREIGN PATENT DOCUMENTS

EP 0 465 033 A1 1/1992

* cited by examiner

*Primary Examiner*—James R. Brittain
(74) *Attorney, Agent, or Firm*—Kusner & Jaffe

(57) ABSTRACT

The buckle of the present invention has a first connection means including two spaced-apart parallel slots for semi-permanently attaching the buckle (10) to a length of webbing in a well-known manner. It has a second connection means, which includes a first aperture (34) and a passageway (36) leading into the first aperture, through which a captive loop of webbing may be guided to locate it within the first aperture. The buckle also includes a second aperture (40), defined by parallel arms (27, 28), which is open in a direction opposite to that of the first aperture, for securing the captive loop in the buckle. When a captive loop of webbing (52) is secured in position, the buckle (10) cannot be shaken loose from the captive loop, but may be easily released when required by simply reversing the fastening procedure.

3 Claims, 2 Drawing Sheets

BUCKLE

FIELD OF THE INVENTION

The present invention relates to buckles and in particular to buckles to be used with rucksacks. This invention further relates to improvements in buckles that may be locked securely.

BACKGROUND OF THE INVENTION

Buckles are used to secure many items including clothing, seatbelts and rucksacks. Many types of buckles are known in the art. Buckles used in conjunction with rucksacks may be used to secure skis or ski poles, tents, articles of bedding or any other necessity to the rucksack, or to hold sections of the rucksack closed. It is desirable that buckles used for these purposes may be locked securely in place. It is often necessary to be able to fasten and unfasten buckles used in this regard in weather conditions that necessitate the wearing of mittens or other clothing that might impede the user's manual dexterity, and so it is also desirable that buckles be easily fastened and unfastened.

An example of a buckle is shown in U.S. Pat. No. 2,285,714, which shows a buckle construction which may be attached to a strap or straps without sewing and which permits adjustment of the length of the strap without sliding of the buckle. A particular disadvantage of this type of buckle is that there is no means of securing the strap in place, and to prevent it slipping out of the tape passage. Also, the buckle construction is such that considerable dexterity is necessary in order to fasten and unfasten the buckle.

Another example is shown in U.S. Pat. No. 2,212,862, which shows a buckle that may be attached to garment or strap. The buckle has two connecting means, one of a permanent nature and the other of a transitional nature. The buckle comprises a main body and at least one arm that forms a slot through which the strap may be passed. A particular disadvantage of this buckle is that while some of the various embodiments may be used with a captive loop of webbing or strapping, it does not allow for the captive loop of webbing or strapping to be secured in place.

Another buckle is shown in EP0465033-A. This buckle is intended to be easy to adjust and connect quickly. However the construction of this buckle does not allow for a captive loop of webbing to be secured in place, as the buckle may be shaken loose from the loop. Neither does it allow for easy fastening and unfastening while the user is wearing mittens or gloves.

There is therefore a need to provide a buckle which can be used with a captive loop of webbing, and which can secure the captive loop of webbing in place. There is also a need to provide a buckle for use with rucksacks, which may be easily fastened and unfastened, even while the user is wearing mittens or gloves, since the weather conditions encountered by the user while using the rucksack will often make such clothing necessary.

SUMMARY OF THE INVENTION

The buckle of the present invention comprises:

a main body, said main body including a first connection means including at least one bar integrally formed with the main body of the buckle, and defining at least one elongate slot therein adapted for receiving a length of webbing or the like; and a securing portion, said securing portion including a second connection means including a first arm integrally formed with the main body of the buckle, wherein said first arm has proximal and distal ends, said proximal end being attached to the main body of the buckle and said first arm extending from the main body of the buckle in a first direction and defining a first aperture therewith, said first aperture having an opening at one end, facing in said first direction, through which a captive loop of webbing may be guided into said first aperture;

characterized in that a second arm is integrally formed with the main body of the buckle, wherein said second arm extends from said first arm in a second direction, substantially opposite to said first direction, and defines a second aperture therewith, wherein said second aperture has an opening at one end, facing in said second direction, adapted to receive said captive loop of webbing.

Preferably, said first opening is a web passageway, said web passageway extending between said main body of the buckle and said distal end of said first arm and being adapted to guide a captive loop of webbing into said first aperture.

In a preferred embodiment of the invention, the first connection means comprises two bars integrally formed with the main body of the buckle, defining two elongate slots therein.

The plane of the buckle may be bent slightly out of the horizontal along a transverse bend line at an angle of about 8°. This reduces the slippage of the webbing through the slots and apertures thus making it harder for the webbing to be pulled through so assisting against accidental release.

The buckle may further comprise a grip portion including a flat extension of the main body of the buckle integrally formed therewith. Said grip portion may further include a plurality of circular perforations defined by said extension, preferably three in number. The grip portion may be used as a finger and thumb grip that allows the buckle to be firmly grasped by the user and hence easily attached to and released from the webbing, even when the user is wearing mittens or other necessary hand covering which would inhibit manual dexterity. The plurality of perforations serve the dual purpose of increasing the grip factor of the grip section of the buckle and also further decreasing the weight of the buckle, thus making the buckle more practical for use with a rucksack in conditions in which the weight of each component which must be carried is significant.

Fastening and unfastening of the buckle from the captive loop of webbing are easily accomplished while wearing mittens or other necessary hand coverings by grasping the entire buckle in one hand and manoeuvring the loop of webbing with the other hand. Since the loop requires only to be slipped into the opening between the first arm and is then secured by twisting the buckle, extensive manual dexterity is not required. The tension on the section of webbing secured by the first connection portion may be released by holding the grip portion of the buckle in the fingers and thumb of one hand, and tilting the buckle so as to slide it along the section of webbing.

Accordingly, the invention provides a buckle with a first connection means including two spaced-apart parallel slots for semi-permanently attaching the buckle to a length of webbing in a well-known manner. It has a second connection means, which includes a first aperture and a passageway leading into the first aperture, through which a captive loop of webbing may be guided to locate it within the first aperture. The buckle also includes a second aperture, defined by parallel arms, which is open in a direction opposite to that of the first aperture, for securing the captive loop in the buckle. When a captive loop of webbing is secured in position, the buckle cannot be shaken loose from the captive loop, but may be easily released when required by simply reversing the fastening procedure.

The term "web" or "webbing" as used throughout the description and claims is intended to include straps, tape and the like. The use of the term "permanent" in relation to the first connection means of the buckle of the present invention is intended to convey that the section of webbing is permanently secured by the first connection means of the buckle while the buckle is being used. However, the webbing may, in fact, be unthreaded from the buckle at any time.

An advantage of this invention is a buckle which may be secured in place when used with a captive loop of webbing.

Another advantage of this invention is a buckle which is light, strong and tough.

A further advantage of the present invention is a buckle which is easy to use, especially when the user is wearing mittens or other clothing which might impede the user's manual dexterity.

DETAILED DESCRIPTION OF PREFERRED EMBODIMENT

Figure 1:
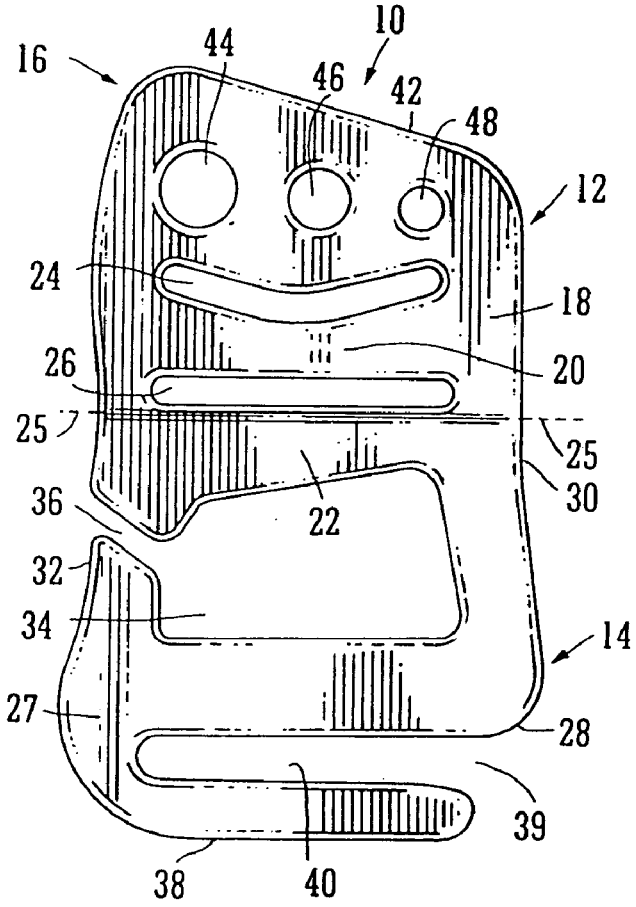
FIG. 1 is a front view of a preferred embodiment of the invention.
Figure 3A:
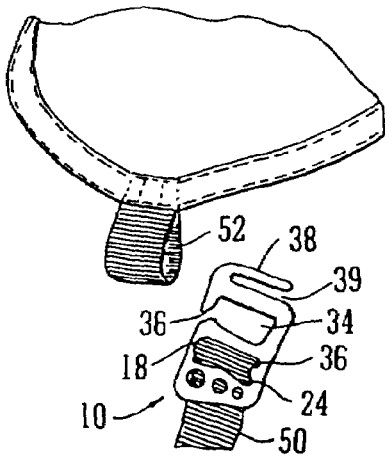
FIGS. 3A, 3B, 3C and 3D show the buckle of the present invention in use with a captive loop of webbing.
Figure 3B:
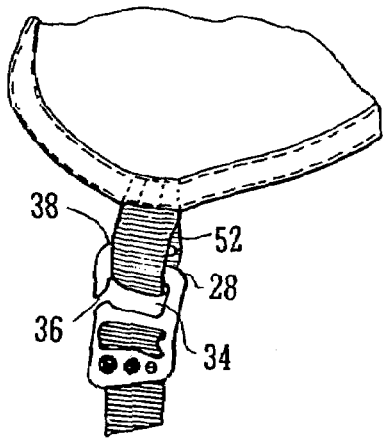
Figure 3C:
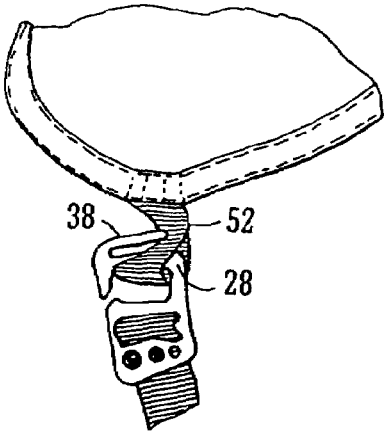
Figure 3D:
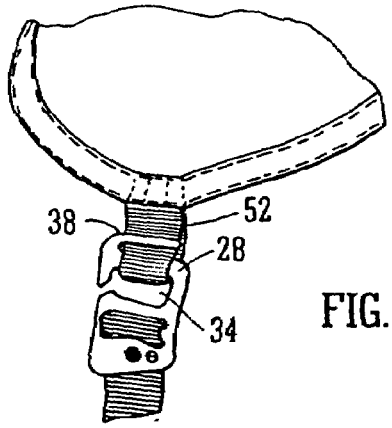

Referring to FIG. 1 of the drawings, a buckle 10 of the invention includes a main body portion 12, a securing means 14 and a grip portion 16. The main body portion 12 includes a first connection means 18 for connecting the buckle to a strap by threading the strap through apertures in the buckle. The first connection means 18 includes two transverse bars 20, 22 integrally formed with the main body portion 12, which define two elongate slots 24, 26 therein. The free end of a section of webbing may be threaded firstly through the elongate slot 24 and then fastened in position by threading it through the second slot 26, in well known manner, as shown in FIG. 3A.

As shown in FIG. 1 the upper slot 24 may be bent at an acute angle to the horizontal, whereas the second lower slot is substantially straight. The slots 24, 26 extend laterally of the buckle and are disposed in spaced, substantially parallel, relative to each other.

A novel feature of the invention is the provision in the buckle of releasable securing means, generally designated 14, by means of which the buckle may engage a captive loop of webbing 52 (see FIG. 3) or the like, be secured to the webbing against accidental release, but be easily disengaged by the user when required.

The releasable securing means 14 comprises a second connection means 27. The second connection means 27 includes a first arm 28, which has proximal and distal ends 30, 32. The first arm 28 is integrally formed with the main body 12 of the buckle 10 and the proximal end 30 of the first arm 28 is attached to the main body 12. The first arm 28 forms a first aperture 34 with the main body 12 of the buckle 10, and a web passageway 36 in communication with the first aperture 34. The web passageway 36 extends between the main body 12 and the distal end 32 of the first arm 28, and is used to guide a captive loop 52 of webbing or the like into the first aperture 34. The web passageway 36 is inclined at an angle to the longitudinal axis of the buckle 10, as shown in FIG. 1, so as to prevent the loop 52 from accidentally escaping from the aperture 34.

The securing portion 14 further includes a second arm 38, integrally formed with the main body 12 and the first arm 28 of the buckle 10. The second arm 38 extends from the first arm 28 and defines a second aperture 40 therewith. The second aperture 40 is adapted to receive the captive loop of webbing. The second arm 38 extends from the body portion in spaced parallel, or substantially parallel relationship to the arm 28. The second arm 38 is turned through approximately 180° relative to the first arm 28, and faces in a direction opposite to that of the first arm 28. The arm 38 is free at its distal end to define with the arm 28, a web passageway 39 communicating with the aperture 40. The opening of the passageway 39 faces in a direction substantially opposite to that of the opening of passageway 36. This feature assists in preventing the accidental release of the web 52 from the aperture 40.

Figure 2:
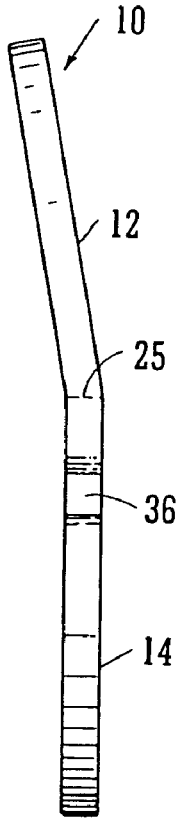
FIG. 2 is a side view of the buckle of the present invention.

The buckle 10 may be planar, but as shown in FIG. 2 it is advantageous if the buckle is bent slightly out of the horizontal along the transverse bend line 25 located approximately mid-way between the main body portion 12 and the securing means 14. Preferably, the main body portion 12 extends at an acute angle, e.g. of about 8°, to the general plane of the securing means 14, or vice versa. This improves the angle at which the captive loop of webbing 52 must pass into the aperture 34.

The grip portion of the buckle 10 is generally designated 16. The grip portion 16 comprises a trapezium-shaped extension 42, integrally formed with the main body 12 of the buckle 10. The extension 42 defines three circular perforations 44, 46, 48 which are of the order of 7 mm, 5.5 mm and 4 mm in diameter respectively. These increase the grip factor of the grip portion 16 of the buckle 10 and also decrease the total weight of the buckle 10.

As shown in FIG. 3 of the drawings, in use of the buckle the free end of a length of webbing 50 is threaded through the slots 24 and 26 of the first connection means 18 of the buckle 10 in order to attach the buckle to the length of webbing 50. The buckle 10 may then also be easily attached to a captive loop of webbing 52, so as to secure an article to a rucksack or other article. The captive loop 52 is formed of a length of webbing having both free ends sewn or otherwise fixed to a rucksack or other article and thus having front and back portions with an opening therebetween. FIG. 3B shows the edge of the captive loop of webbing 52 guided into the first aperture 34 by way of the web passageway 36, so that the first arm 28 and the second arm 38 both lie between the front and back portions of the captive loop of webbing 52. FIG. 3C shows the buckle 10 being twisted to bring the second arm 38 in front of both the back and front portions of the captive loop 52, with the first arm 28 remaining within the loop. FIG. 3D shows the buckle 10 in the final secured position, wherein the first arm 28 lies within the loop of webbing 52 and the second arm 38 lies in front of both portions of the loop. Thus, the loop 52 is locked into the aperture 40. In the secured position, the buckle 10 cannot be shaken loose from the captive loop of webbing 52, but may be easily released when required by simply reversing the fastening procedure.

The buckle of the present invention may be formed from a light, durable metal alloy. The use of this material means that the buckle is extremely light, robust and locks securely. Alternatively the buckle may be moulded from a suitably plastics, or a metal reinforced plastics.

The words "comprises/comprising" and the words "having/including" when used herein with reference to the present invention are used to specify the presence of stated features, integers, steps or components but does not preclude the presence or addition of one or more other features, integers, steps, components or groups thereof.

The invention claimed is:

1. A buckle comprising a main body portion, a grip portion and a securing portion for securing a captive loop of webbing or the like, said buckle having a front and a back portion with an opening therebetween, all of which are integrally formed therewith, wherein:

said main body portion includes a first rectilinear elongate closed-ended slot and a second elongate closed-ended slot bent at an angle at its center point so as to form a substantially flattened V-shape, said first and second elongated slots being defined by two transverse bars integrally formed with said main body portion, said slots extending laterally of the buckle and being disposed in spaced, substantially parallel, relative to each other, wherein the respective ends of said slots are equidistant, said slots adapted to ensure the connection of the buckle to a free-ended length of webbing when this free length is threaded in succession through the first and the second slot;

the grip portion is integrally formed with said main body portion and opposite to said securing portion;

the securing portion includes a first arm having the proximal end attached to and extending from the main body in a first direction perpendicular to the longitudinal axis of the buckle so as to define a first aperture therewith, the said first aperture having a first and narrower opening facing in said first direction at the distal end of said first arm, said first opening being a passageway inclined at an angle to the longitudinal axis of the buckle which is adapted to guide a captive loop of webbing into said first aperture which has an enlarging width starting from said first opening; and a second arm which extends from said first arm in a second direction, substantially opposite to said first direction, so as to define a second aperture therewith, the said second aperture having a second opening facing in said second direction and adapted to lock said loop after the buckle has been twisted in order to bring said second arm in front of both the front and back portions of the captive loop, with said first arm remaining within the loop.

2. The buckle of claim 1, wherein the buckle is bent along a transverse bend line substantially perpendicular to the longitudinal axis of the buckle at an acute angle.

3. The buckle of claim 1, wherein the grip portion comprises a substantially planar extension which is trapezium-shaped and defines a plurality of perforations.

* * * * *